United States Patent [19]

Tipton

[11] 4,359,451

[45] Nov. 16, 1982

[54] DESULFURIZATION OF CARBONACEOUS MATERIALS

[75] Inventor: Ann B. Tipton, Diamond Bar, Calif.

[73] Assignee: Occidental Research Corporation, Irvine, Calif.

[21] Appl. No.: 939,688

[22] Filed: Sep. 5, 1978

[51] Int. Cl.[3] ..... C10L 9/04; C01B 17/16; C01B 31/02

[52] U.S. Cl. ..... 423/563; 423/461; 44/1 SR; 201/17; 201/31; 208/8 R

[58] Field of Search ..... 423/460, 461, 561 R, 423/563; 201/17, 31; 44/1 R; 208/8 R, 210, 211, 212

[56] References Cited

U.S. PATENT DOCUMENTS

| | | | |
|---|---|---|---|
| 1,287,634 | 12/1918 | Chaney | 423/460 |
| 2,717,868 | 9/1955 | Gorin et al. | 423/461 |
| 2,721,169 | 10/1955 | Mason et al. | 202/31 |
| 2,872,384 | 2/1959 | Nelson et al. | 202/31 |
| 2,878,163 | 3/1959 | Hutchings | 202/31 |
| 2,983,673 | 5/1961 | Grove | 208/152 |
| 3,007,849 | 11/1961 | Nelson et al. | 201/17 |
| 3,009,781 | 11/1961 | Johnson et al. | 23/206 |
| 3,130,133 | 4/1964 | Loeuenstein | 423/461 |
| 3,214,346 | 10/1965 | Mason et al. | 202/31 |
| 3,251,751 | 5/1966 | Lindahl et al. | 201/12 |
| 3,387,941 | 6/1968 | Murphy et al. | 23/209.9 |
| 3,393,978 | 7/1968 | Murphy et al. | 23/209.9 |
| 3,402,998 | 9/1968 | Squires | 23/181 |
| 3,598,528 | 8/1971 | Franz et al. | 201/17 |
| 3,600,130 | 8/1971 | Aldridge | 423/461 |
| 3,640,016 | 2/1972 | Lee et al. | 44/1 |
| 3,812,017 | 5/1974 | Santangelo et al. | 201/17 |
| 3,824,084 | 7/1974 | Dillon et al. | 44/1 R |
| 3,909,212 | 9/1975 | Schroeder | 44/1 R |
| 3,919,118 | 11/1975 | Robinson et al. | 423/461 |
| 4,052,170 | 10/1977 | Yan | 201/17 |
| 4,053,285 | 10/1977 | Robinson et al. | 44/1 F |
| 4,054,421 | 10/1977 | Robinson et al. | 44/1 F |
| 4,087,514 | 5/1978 | Robinson et al. | 423/461 |

OTHER PUBLICATIONS

Block et al., "Effectiveness of Gases in Desulphurization of Coal", Fuel, vol. 54, Apr. 1975, pp. 113 to 120.

*Primary Examiner*—Gary P. Straub
*Attorney, Agent, or Firm*—Forrest E. Logan

[57] ABSTRACT

Solid carbonaceous material, especially coal or coal char, is desulfurized by treatment with a limited amount of hydrogen to convert the organic sulfur to sulfide sulfur at an elevated temperature. The thusly formed sulfide sulfur is then removed from the solid carbonaceous material by steam treatment or other means.

31 Claims, 9 Drawing Figures

DESULFURIZATION OF CARBONACEOUS MATERIALS

BACKGROUND OF INVENTION

Sulfur-bearing carbonaceous fuels when burned for purposes of producing energy also produce pollutants such as oxides of sulfur, especially sulfur dioxide. Sulfur dioxide in the atmosphere undergoes photo-oxidation to form sulfur trioxide which, under certain conditions, is converted to sulfuric acid or a sulfate aerosol. An excess of these pollutants is detrimental to the health of mankind, the growth of plants, and in cases of severe excess the useful life of various materials of construction and articles of manufacture. Reduction in the sulfur content of solid carbonaceous materials prior to their conversion into energy offers a solution to the reduction of sulfur pollutants in the atmosphere.

Sulfur exists in solid carbonaceous materials as either organic sulfur or inorganic sulfur. Inorganic sulfur comprises pyritic sulfur, sulfide sulfur, sulfate sulfur, and in some instances other forms of inorganic sulfur generally in relatively small amounts. Organic sulfur is the sulfur which forms a part of organic molecules of the carbonaceous material; pyritic sulfur comprises iron pyrite, $FeS_2$; and sulfide sulfur comprises, for example, FeS and CaS. "Pyritic sulfur" as used herein does not comprehend "sulfide sulfur" as used herein. Sulfur bound to organic molecules is often considered the most difficult form of sulfur to essentially completely remove because of the strong complex organic bonds which tightly hold the sulfur.

U.S. Pat. No. 2,878,163 discloses a process for desulfurizing petroleum coke by mixing the petroleum coke after it has been pulverized with a solid alkali metal hydroxide selected from the group consisting of sodium hydroxide, potassium hydroxide, and lithium hydroxide, heating and maintaining the mixture at a temperature of at least about 700° F. to react with the impurities in the petroleum coke.

U.S. Pat. No. 3,387,941 discloses a process for desulfurizing carbonaceous material by treating with steam in an intimate mixture containing such material and an alkali metal hydroxide, oxide, carbide, carbonate, or hydride at a temperature of about 500° to 850° C. while the hydroxide of the alkali metal is a liquid.

U.S. Pat. No. 3,393,978 discloses a process for deashing carbonaceous material by treatment with a mixture containing an alkali metal compound and the carbonaceous material with steam at a temperature above the melting point of the hydroxide of the alkali metal, washing the treated material with water, and treating the water-washed material with an aqueous solution of a water-soluble inorganic acid capable of forming water-soluble salts of the impurities.

Molten media have also been used to desulfurize carbonaceous material, such as U.S. Pat. No. 4,087,514 to Robinson et al employing a basic molten bath of an alkali metal or alkaline earth metal salt of a hydroxyaryl or an alcohol, and in U.S. Pat. No. 3,919,118 to Robinson et al employing a molten bath of an alkaline salt from an organic acid comprising the cresylic acid fraction from the distillation of coal tar and a caustic material selected from the group consisting of alkali metal, and alkaline metal oxides, hydroxides, carbonates, acetates or mixtures thereof.

U.S. Pat. No. 3,812,017 discloses a process for desulfurizing coal by mixing crushed coal with an acid selected from phosphoric acid, phosphorous acids and mixtures thereof, removing the excess acids, if any, from the mixture, and heating the mixture to a temperature between about 400° and about 1100° C. for at least about 15 minutes. The process is said to remove a significant quantity of the organic sulfur and substantially all of the inorganic sulfur.

U.S. Pat. No. 3,824,084 discloses a process for desulfurizing a coal containing pyritic sulfur by treatment with water and air at an elevated temperature and pressure to convert the pyritic sulfur to water-soluble ferrous and ferric sulfate. The resulting slurry is then filtered to produce a coal product of diminished sulfur content.

Carbonaceous material may also be desulfurized by treatment with acid followed by hydrogen treatment as in U.S. Pat. No. 4,054,421 to Robinson et al.

U.S. Pat. No. 3,402,998 discloses a process for desulfurizing a fuel which is undergoing gasification, cracking, hydrogasification, or hydrocracking by use of a hydrogen sulfide acceptor particle such as calcine dolomite.

U.S. Pat. No. 3,640,016 discloses a method for desulfurizing caking coal without substantial caking, devolatilization and conversion to coke or char by mixing a solid particulate getter material with the particulate sulfur-containing caking coal, passing hydrogen gas through the mixture to form a fluidized bed of the particulate mixture, which is maintained at a temperature of 600° to 800° F., to form a nongaseous sulfide by reaction of the coal with the getter and the hydrogen, and separating the nongaseous sulfide and unreacted getter material from the mixture to recover uncaked particulate desulfurized coal without substantial devolatilization. It is further disclosed that various thermodynamic studies of the reaction:

$$FeS+H_2 \rightarrow Fe+H_2S$$

indicate that even at temperatures as high as 1300° F., the equilibrium partial pressure ratio of hydrogen sulfide to hydrogen is still so low that a tremendous recycle of hydrogen is necessary. At equilibrium conversion some 400,000 s.c.f. of hydrogen have to be recirculated to reduce the sulfur in one ton of coal from 4 to 0.5 percent.

U.S. Pat. No. 2,983,673 discloses a process for desulfurizing petroleum coke by first fracturing the coke particles and then treatment with hydrogen or steam or other agents such as sulfur dioxide.

It is known that sulfur may be removed from fluid coke by treatment with hydrogen or hydrogen-containing gases at a temperature of 2400° F. by the formation of hydrogen sulfide, as in U.S. Pat. No. 2,872,384.

U.S. Pat. No. 3,251,751 discloses a process for desulfurizing char particles as they descend by gravity with a counter-current stream of reducing gas, such as hydrogen, which removes a portion of the sulfur in the char as hydrogen sulfide. The gas should be substantially free of hydrogen sulfide.

U.S. Pat. No. 3,009,781 discloses a process for the reduction of the sulfur content of coke particles by treatment with hydrogen sulfide in a fluidized bed heated by the passage of electricity through the bed to produce carbon disulfide.

U.S. Pat. No. 2,721,169 discloses a process for desulfurizing a high-sulfur petroleum coke from a fluidized coking process by subjecting the coke particles to low-temperature oxidation with an oxygen-containing gas followed by a hydrogen treatment. The process involves subjecting the coke particles in the form of a dense turbulent fluidized bed to a low-temperature oxidation treatment followed by a hydrogen treatment. The hydrogen treatment is conducted at a temperature of about 1200° to 1700° F., preferably at 1400° to 1500° F., at atmospheric pressure or above. The coke is contacted at suitable temperature and pressure with a flow of hydrogen which sweeps the hydrogen sulfide product out of the hydrogen treatment zone. The minimum flow of hydrogen utilized is about 100 volumes of hydrogen per volume of coke per hour. Treatment time ranges from 10 minutes to about 10 hours.

U.S. Pat. No. 3,909,212 discloses a process for desulfurizing solid carbonaceous fuels such as coal or lignite by reacting the fuel with oxygen and steam so as to generate nascent hydrogen at the surface and within the fuel particle for reaction with the sulfur in the fuel to form hydrogen sulfide. The reaction is conducted at a pressure of at least about 2 atmospheres and at a temperature of about 1100° to about 1500° F. A portion of the fuel is burned to reach the elevated temperature required.

The effect of air, steam and hydrogen on the desulfurization of bituminous coal, together with an oxidative pretreatment followed by hydrogen treatment, is discussed in a publication entitled "Fuel," Volume 54, at page 113 (1975). A coal, pretreated by heating while exposed to air, was shown to desulfurize faster than the coal which was not pretreated.

U.S. Pat. No. 3,214,346 discloses a process for removing ash components from fluid coke by increasing the porosity of the fluid coke particles by low-temperature oxidation and/or steaming followed by either treatment with gaseous reagents such as chlorine and hydrogen chloride, or by extraction with reagents such as aqueous alkaline materials, acids, and the like. For example, after the low-temperature oxidation of the high surface area coke particles, they may be extracted with an ammonium hydroxide solution or with a sodium hydroxide solution.

Sulfur bearing coal char may be desulfurized as in U.S. Pat. No. 4,053,285 to Robinson et al by treatment at elevated temperatures with carbon dioxide and steam.

SUMMARY OF THE INVENTION it has been discovered that treatment of a solid carbonaceous material containing both organic and inorganic sulfur, especially carbonaceous material such as coal char with a relatively small amount of hydrogen will transform the organic sulfur to sulfide sulfur. The treated solid carbonaceous material is such that the total sulphur content of the solid carbonaceous material remains essentially the same as it was before hydrogen treatment. By "essentially the same" as used herein is meant that the percentage of sulfur in the solid carbonaceous material after treatment with hydrogen is at least about 80 percent of the percentage of sulfur in the solid carbonaceous material before treatment with hydrogen. Thus, for example, a 100 gr sample solid carbonaceous material containing 5 gr of sulfur will contain at least about 4 gr of sulfur per 100 gr of solid residue of the solid carbonaceous material after treatment regardless of the final weight of the solid residue.

In some embodiments, depending on reactor type, the organic sulfur is transformed to sulfide sulfur by treatment with about 100 to 100,000 scf of hydrogen per ton of solid carbonaceous material. In another embodiment, 100 to 10,000 scf of hydrogen per ton of solid carbonaceous material is used. Where it is desirable to minimize the amount of hydrogen, an embodiment of my invention employing as little as 100 to 1,000 scf of hydrogen per ton of solid carbonaceous material offers economic advantages. However, regardless of the amount of hydrogen used per unit weight of solid carbonaceous material, the total sulfur content of the solid carbonaceous material after treatment is at least about 80 percent of that before treatment.

The gas used for treatment comprises hydrogen in an amount from about 10 mole percent to pure hydrogen.

Sulfur-bearing solid carbonaceous materials to which this invention may be applied are coal, coal char, a product produced from coal char, bituminous coal, bituminous coal char, coal that has been pretreated with oxygen, carbonaceous material with mineral matter, carbonaceous material with mineral matter comprising iron or calcium, high ash solid residue from coal liquefaction processes, especially high ash solvent refined coal processes and products therefrom, petroleum coke, delayed coke, char produced by pyrolysis of the aforementioned materials, especially bituminous coal, and especially char produced by flash pyrolysis especially flash pyrolysis of agglomerative bituminous coal.

Furthermore, it has been found that the total sulfur in the solid carbonaceous material can be increased without detriment to this invention. Thus, in the above illustration the weight of sulfur in the solid residue carbonaceous material may exceed the original 5 gr as may occur if the gas containing hydrogen also contains sufficient hydrogen sulfide to react with the mineral matter in the solid carbonaceous material.

Therefore, it has also been discovered that the hydrogen need not be pure hydrogen and, in fact, a gas comprising hydrogen can be used which also contains up to several percent hydrogen sulfide. While I do not wish to be bound by theory, it is believed that hydrogen sulfide content is not a controlling factor since the transformation and process desired is not organic sulfur to hydrogen sulfide followed by removal of the thusly formed hydrogen sulfide as found in the art, but organic sulfur to sulfide sulfur. Thus, the hydrogen sulfide content of the hydrogen-containing gas is of secondary importance in the transformation.

Therefore, in another embodiment of my invention the total sulfur content of the solid carbonaceous material is controlled by controlling the amount of hydrogen sulfide in the gas comprising hydrogen used for conversion of the organic sulfur to sulfide sulfur. Thus, when using a treating gas which contains a larger percentage of hydrogen and/or when used in a relatively larger quantity, for example 10,000 to 100,000 scf of hydrogen per ton of solid carbonaceous material, control of the total sulfur can be effected by using a higher percentage of hydrogen sulfide in the treating gas. Therefore, in one embodiment of my invention the treating gas comprises about 2 mole percent hydrogen sulfide.

Furthermore, though I do not wish to be bound by theory, it is believed that the mineral content of the solid carbonaceous material acts as an in situ catalyst in the promotion of the reaction transforming the organic sulfur to sulfide sulfur and also acts as a sulfur acceptor or scavenger. Thus, in one embodiment it is beneficial to have the original mineral matter remain in the hydrogen-treated carbonaceous material.

The treatment of the solid carbonaceous material with a gas comprising hydrogen is effected in a conversion zone which may be an entrained flow or transport reactor, fixed bed reactor, packed bed reactor, or a fluidized bed reactor. By entrained flow reactor or transport reactor herein is meant that the gas and particulate material have essentially the same velocity through the reactor. Batch or continuous flow reactors may be used. The choice of the reactor type will be governed by the type of solid carbonaceous material to be treated, its size, porosity and density, as well as the quantity of treating gas per unit weight of solid carbonaceous material.

The treatment temperature is from about 1000° to about 2000° F. Higher temperatures, although they may be used, are not preferred because thermal losses are higher, which is not economically desirable and because material losses, due to additional devolatilization of the solid carbonaceous material, are increased. Lower temperatures are not preferred because of the lower kinetic rates.

The treatment time, or residence time, of the solid carbonaceous material in the conversion zone depends on the choice of amount hydrogen to unit weight of solid carbonaceous material, temperature, and reactor type; but in general treatment times range from about 10 seconds to about 2 hours. Shorter treatment times may be employed if a series or repetitive process is used.

After converting the organic sulfur in the solid carbonaceous material to sulfide sulfur, the sulfide sulfur is then removed from the solid carbonaceous material to produce a desulfurized solid carbonaceous material in a desulfurization zone. The sulfide sulfur may be removed from the solid carbonaceous material by treatment with steam, or an acid in an aqueous solution, or partial oxidation of the char, or magnetic separation, or any other suitable sulfide removal method.

Preferably sulfide sulfur is removed by treatment with steam. Preferably the treatment is at a temperature of about 800° to about 1600° F., a pressure of about atmospheric to about 50 psig, and for a period of time between about five minutes to about several hours depending on the steam-to-solid carbonaceous material ratio, the temperature, and the amount of sulfur to be removed. Temperatures over about 1400° F., and especially over 1600° F., causes appreciable gasification of the carbon content of the solid carbonaceous material which may not be desirable. However, since the reaction is endothermic, the higher temperatures improve the extent of the sulfide sulfur removal which is desirable. Temperatures below 1000° F., and especially below 800° F., are not desirable because of the slower kinetic rate of reaction.

During the steam treatment, the sulfide sulfur is removed by conversion of the sulfide sulfur to hydrogen sulfide. While I do not wish to be bound by theory, the mineral oxides and hydroxides remain with the desulfurized coal char and the hydrogen sulfide is vented from the reactor with the excess steam.

The desulfurization zone may employ the same vessel as the conversion zone as in batch processes, or it may be in a completely separate zone apart from the conversion zone as in continuous processes. The desulfurization zone may employ an entrained flow reactor, a fixed bed reactor, a packed bed reactor, or a fluidized bed reactor. The choice of the reactor type will be governed by the type of carbonaceous material to be treated, its size, porosity and density, as well as the quantity of treating gas per unit weight of solid carbonaceous material.

The desulfurized solid carbonaceous material is then removed from the desulfurization zone and recovered.

In another embodiment of my invention, the desulfurized solid carbonaceous material is subjected to a similar treatment as described above in a second conversion zone, followed by treatment in a second desulfurization zone, in order to obtain a greater degree of desulfurization. There is no limit to the number of cycles which may be employed; however, it has been found that two or three cycles will remove as much as 90 percent of the initial sulfur in the fresh solid carbonaceous material.

In still another embodiment of my invention, solid carbonaceous material containing mineral matter is pretreated with steam to activate the mineral matter and thereby enhance the conversion of organic sulfur contained therein to inorganic sulfur, especially sulfide sulfur.

DESCRIPTION OF THE PREFERRED EMBODIMENT

Figure 1:
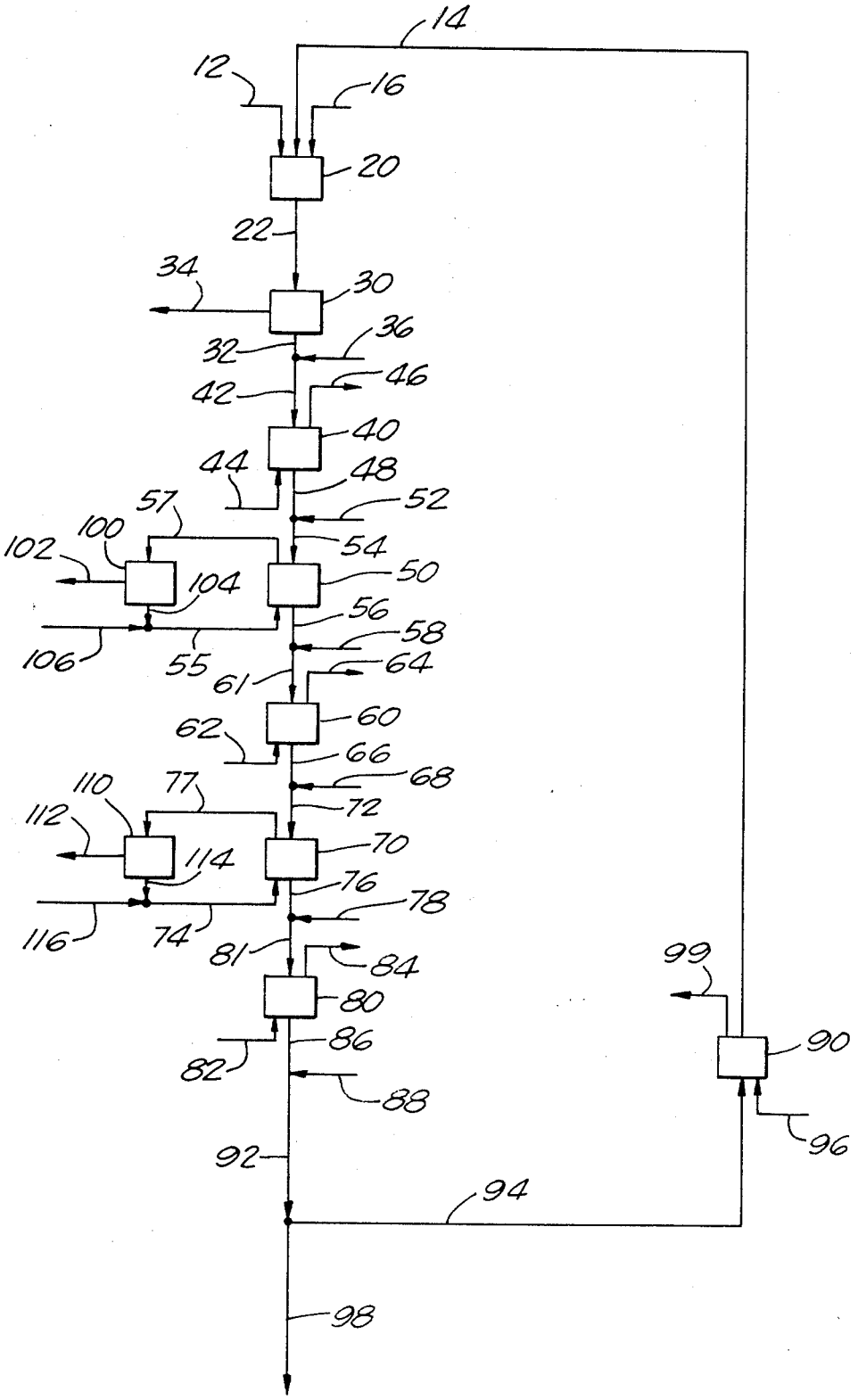
FIG. 1 is a block flow diagram of the preferred embodiment of the process.

In my process to produce a low-sulfur char, as shown in FIG. 1, a high-sulfur bituminous agglomerative coal from line 12, together with hot char from line 14 and a gas from line 16, are fed into entrained flow reactor 20 which is operated at a temperature of from about 800° F. to about 1800° F., preferably about 1100° F., to produce valuable volatile products and a flash pyrolysis coal char. The residence time in the reactor is about 0.5 seconds to about 10 seconds, preferably about 2 seconds. The gas may comprise hydrogen to hydrotreat and upgrade the volatile products produced by pyrolysis.

During the flash pyrolysis, some of the pyritic sulfur and organic sulfur in the coal is converted to sulfide sulfur and volatile sulfur containing gases. After pyrolysis the materials are removed from pyrolyzer 20 through conduit 22 and enter separator 30 wherein the char product is separated and removed through conduit 32, from the volatile gaseous products which are removed through conduit 34 and recovered by means known to those skilled in the art. Separator 30 may be a cyclone type separator or any suitable gas-solid separating means.

The char product from conduit 32, together with a fluidizing gas from conduit 36, enters a fluidized bed first stage desulfurization zone 40 through mean conduit 42. Steam is introduced through conduit 44 into fluidized bed first-stage desulfurization zone 40, whereupon at least a portion of the sulfide sulfur in the pyrolysis char is removed from the char by its conversion to hydrogen sulfide. Preferably about 50% to about 80% of the sulfide sulfur is removed from the char. The pretreatment with steam activates the mineral matter in the char and enhances the conversion of organic sulfur contained therein to inorganic sulfur in subsequent steps as will be described.

The hydrogen sulfide and the excess steam are removed from the desulfurization zone 40 through conduit 46. The treated char is removed from the desulfurization zone 40 through conduit 48.

Desulfurized char from conduit 48 is fed to a fluidized bed first-stage conversion zone 50 with a fluidizing gas from conduit 52 by way of mean conduit 54. A gas containing hydrogen is fed to conversion zone 50 through conduit 55. About 100 scf to about 1000 scf of hydrogen is fed to conversion zone 50 per ton of char fed to the conversion zone. In conversion zone 50 at least part of the organic sulfur of the char is converted to sulfide sulfur; however, the total sulfur content of the char from conversion zone 50 is essentially the same as, and at least 80 percent of, that of the char from desulfurization zone 40.

Converted char is removed from conversion zone 50 through conduit 56, while a spent gas is removed through conduit 57.

Converted char from conduit 56, together with a fluidizing gas from conduit 58, is fed to fluidized bed second-stage desulfurization zone 60 through mean conduit 61, together with steam which is introduced through conduit 62. In desulfurization zone 60 at least a portion of the sulfide sulfur in the treated char is removed from the char by its conversion to hydrogen sulfide. Preferably about 50% to about 100% by weight of the sulfur is removed as a result of treatment in the desulfurization zone 60. A vent gas comprising the hydrogen sulfide and the excess steam is removed from desulfurization zone 60 through conduit 64, while the desulfurized char is removed through conduit 66.

The desulfurized char from conduit 66, together with a fluidizing gas from conduit 68, enter a fluidized bed second-stage conversion zone through means conduit 72.

A gas containing hydrogen enters conversion zone 70 through conduit 74. About 10,000 scf to about 15,000 scf of hydrogen is fed to conversion zone 70 per ton of char fed to the conversion zone. In conversion zone 70 at least part of the organic sulfur of the char from desulfurization zone 60 is converted to sulfide sulfur; however, the total sulfur content of the char from conversion zone 70 is essentially the same as, and at least 80 percent of, that of the char from desulfurization zone 60.

Converted char is removed from conversion zone 70 through conduit 76, while a spent gas is removed through conduit 77.

Converted char from conduit 76, together with a fluidizing gas from conduit 78, is fed to a fluidized bed third-stage desulfurization zone 80 through mean conduit 81. Steam is introduced through conduit 82 into desulfurization zone 80, whereupon at least a portion of the sulfide sulfur in the char is removed from the char by its conversion to hydrogen sulfide. Preferably sufficient steam treatment is conducted to remove essentially all of the remaining sulfur in the remaining char. A vent gas comprising the hydrogen sulfide and excess steam is removed from desulfurization zone 80 through conduit 84, and desulfurized char is removed through conduit 86. Vent gas streams 46, 64, and 84 may be adapted for heat recovery and/or fluidizing purposes, after sufficient purification, as for example streams 36, 58, or 78.

A portion of the desulfurized char from conduit 86, together with a fluidizing gas from conduit 88, is fed to a combustion zone 90 through mean conduits 92 and 94, together with air from conduit 96. A small percentage of the desulfurized char is partially oxidized in combustion zone 90 to produce a hot char which is recycled to pyrolyzer 20 through conduit 14 to provide the heat required for pyrolysis of the fresh carbonaceous feed material. Hot char produced in this manner as a solid particulate source of heat may also be provided to any one or all of desulfurization zones 40, 60, or 80 and to either or both of conversion zones 50 or 70 to provide the heat necessary to reach and/or maintain the desired temperatures in the respective zones. Alternately, such zones may be heated by introducing oxygen, preferably a gas containing about 1 to about 10 percent oxygen, into the zones to partially combust and heat the carbonaceous material in the zones. A desulfurized char product is removed and recovered from the process through conduit 98.

Flue gases are removed from combustion zone 90 through conduit 99. These gases may be used to supply a portion of the fluidizing gas entering in conduits 36, 52, 58, 68, 78 and 88, as well as a carrier gas, if needed, for the coal transported in conduit 12 or at any other particulate material in the process where needed or desired. This embodiment has the advantage of producing a flue gas of lower sulfur content, which is removed through conduit 99, than if a higher sulfur content char is used.

However, in an alternate embodiment, not shown in FIG. 1, the char from pyrolysis zone 20 after separation from the volatile gaseous products in separator 30 is partially combusted in a combustion zone and recycled to pyrolysis zone 20 to provide the heat required for pyrolysis of the fresh carbonaceous feed material. Hot char so produced may also be used for heating desulfurization zones 40, 60, and 80, and conversion zones 50 and 70. This embodiment has an advantage in that some sulfur is usually removed from the char during partial oxidization.

The spent gas from fluidized bed first-stage conversion zone 50 and conduit 57 is fed to purifier 100 to remove impurities such as hydrogen sulfide. These impurities are removed from purifier 100 in conduit 102, while the purified gas is recycled to conversion zone 50 through conduits 104 and 55, together with a make-up gas comprising hydrogen through conduit 106.

Similarly, the spent gas from fluidized bed second-stage conversion zone 70, which is removed through conduit 77, is fed to purifier 110 to remove impurities such as hydrogen sulfide. The impurities are removed from purifier 110 through conduit 112, and the purified gas through conduit 114. Purified gas is recycled to conversion zone 70 through conduits 114 and 74, together with a make-up gas comprising hydrogen through conduit 116.

In one embodiment, at least one of the conversion zones and preferably both are treated with only a predeteramount of hydrogen so that all the hydrogen sulfide evolved is essentially or nearly essentially reacted with the mineral matter in the carbonaceous material or char. In this preferred embodiment, removal of hydrogen sulfide from the flue gas stream or streams, that is removed in conduit 57 and/or 77, is not required.

It is not necessary in all embodiments of this invention to purify the spent gases from the conversion zone before they are recycled to the conversion zone. In fact, in another embodiment of my invention the spent gases are not purified before recycle. This is possible because my process does not require a gas which is free of hydrogen sulfide or a gas which has a very low concentration of hydrogen sulfide.

It is understood that in the embodiment, wherein the conversion zone is a fluidized bed, the gases are recycled in order to maintain the motion of the bed, to improve the contact between the gases and the char, and to conserve the amount of hydrogen required for the process.

In another embodiment of my invention, not shown in FIG. 1, the char from the pyrolysis zone 20 after separation from the volatile gaseous products in separator 30 is partially combusted in a combustion zone before it is fed to the first stage desulfurization zone 40. In this embodiment, combustion zone 90 may be eliminated if the desulfurized char removed from the final desulfurization zone in conduit 92 is hot enough to serve as a particulate source of heat in the pyrolysis zone for the carbonaceous feed material.

The total hydrogen fed to the process is about 11,000 scf per ton of flash pyrolysis coal char produced by the process per percent of sulfur removed.

Figure 2:
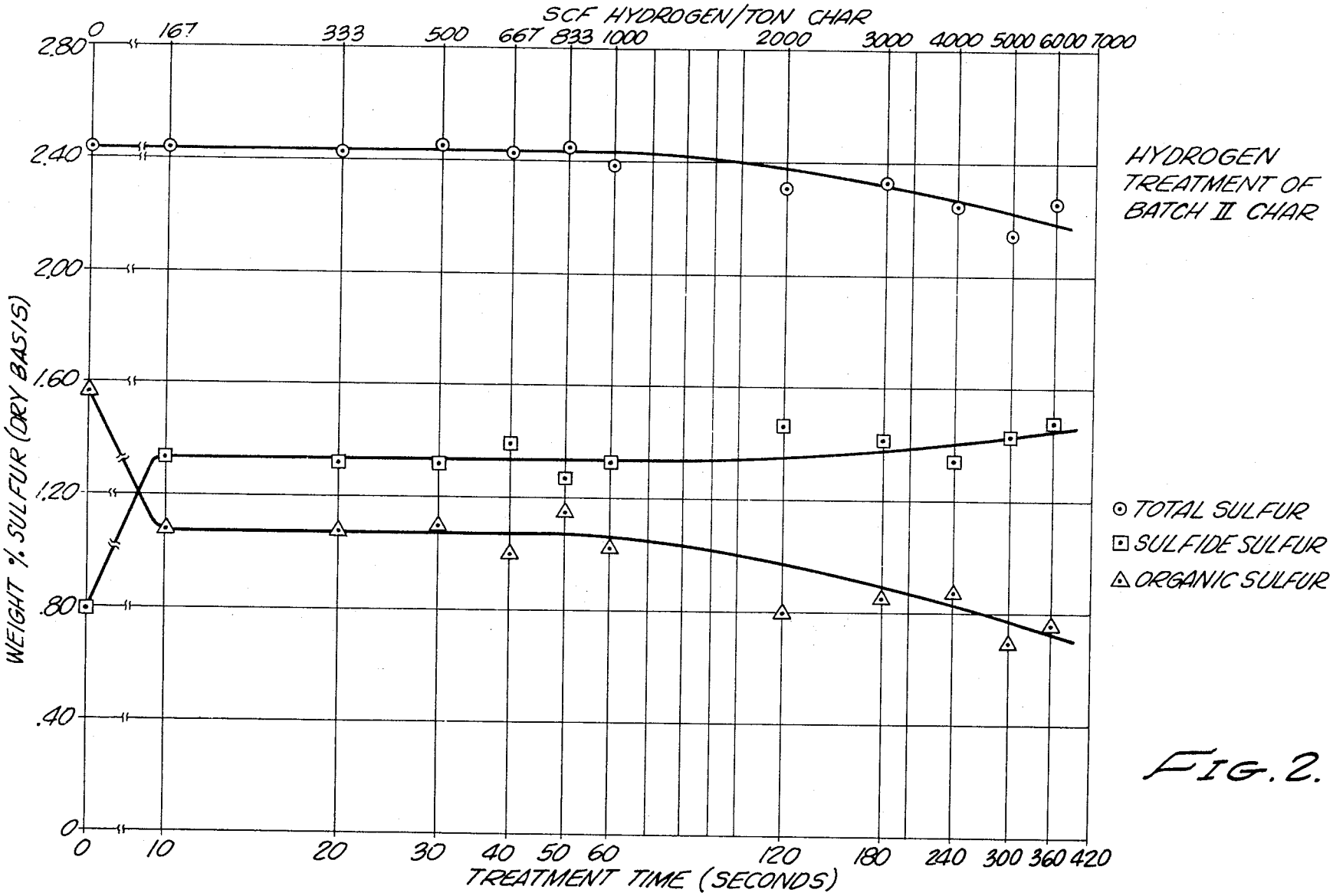
FIG. 2 is a graph of the sulfur content of Batch II char when treated with hydrogen for various treatment times.

FIG. 2 is a graph of total sulfur, sulfide sulfur, and organic sulfur in Batch II char as a function of time and/or the scf of hydrogen per ton of char treated. In these experiments, a flow rate of 1,000 scf of hydrogen per minute per ton of char was used. The experiments were conducted using a batch-type fluidized bed reactor. The treating gas used was 80 percent by volume hydrogen and the balance nitrogen. FIG. 2 shows that the total sulfur content of the char remains constant after about 10 seconds of hydrogen treatment. FIG. 2, therefore, is an example of how organic sulfur is converted to inorganic sulfur, or sulfide sulfur, by treatment with hydrogen without appreciably lowering the total sulfur content of the char. It can be seen from the figure that organic sulfur is reduced from about 1.6 percent to about 0.8 percent, while inorganic or sulfide sulfur is increased from about 0.8 percent to about 1.6 percent.

The hydrogen treatment of char in FIG. 2 was conducted at a temperature of 1600° F., a pressure of 50 psig, in a reactor having an inside diameter of 35 mm, and a gas superficial velocity of 0.05 feet per second using a sample size of 25 gr.

Figure 3:
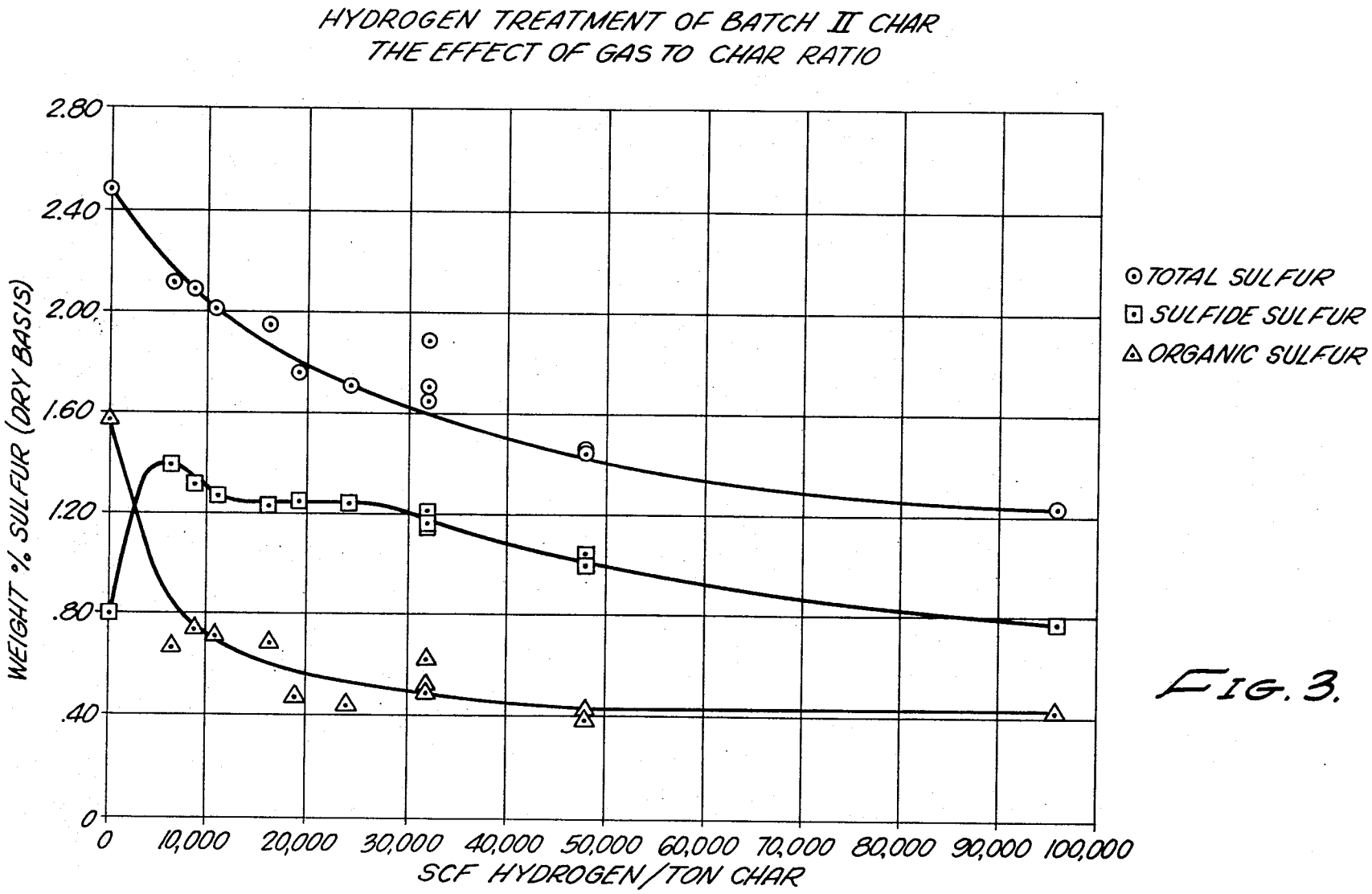
FIG. 3 is a graph of hydrogen treatment of Batch II char showing the effect of gas-to-char ratio.

FIG. 3 represents a collection of data showing the effect of treating Batch II char with hydrogen. All tests were conducted at a temperature of 1600° F.; however, hydrogen treatment was conducted over various periods of time. The curves show that the total sulfur content of the char was continuously reduced as more hydrogen per ton of char was used to desulfurize the char. Furthermore, it can be seen that the organic sulfur content of the char reached an asymptotic value of approximately 0.4 percent sulfur. The conditions under which this char was desulfurized show that the total sulfur content of the char is appreciably reduced and does not remain constant. This curve, therefore, represents what one ordinarily skilled in the art would expect to achieve by treatment of char with a gas containing molecular hydrogen.

Figure 4:
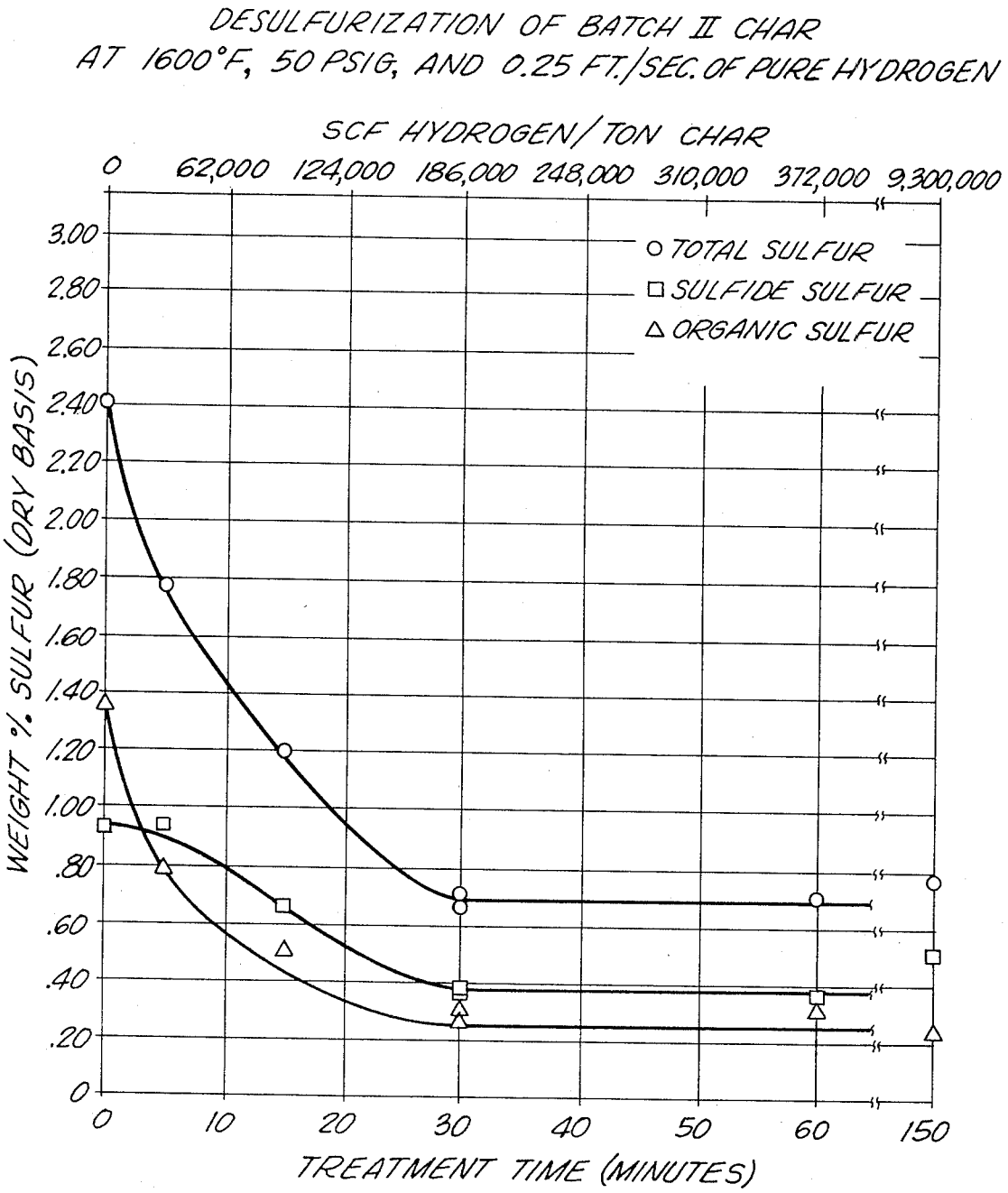
FIG. 4 is a graph of desulfurization of Batch II char with pure hydrogen.
Figure 5:
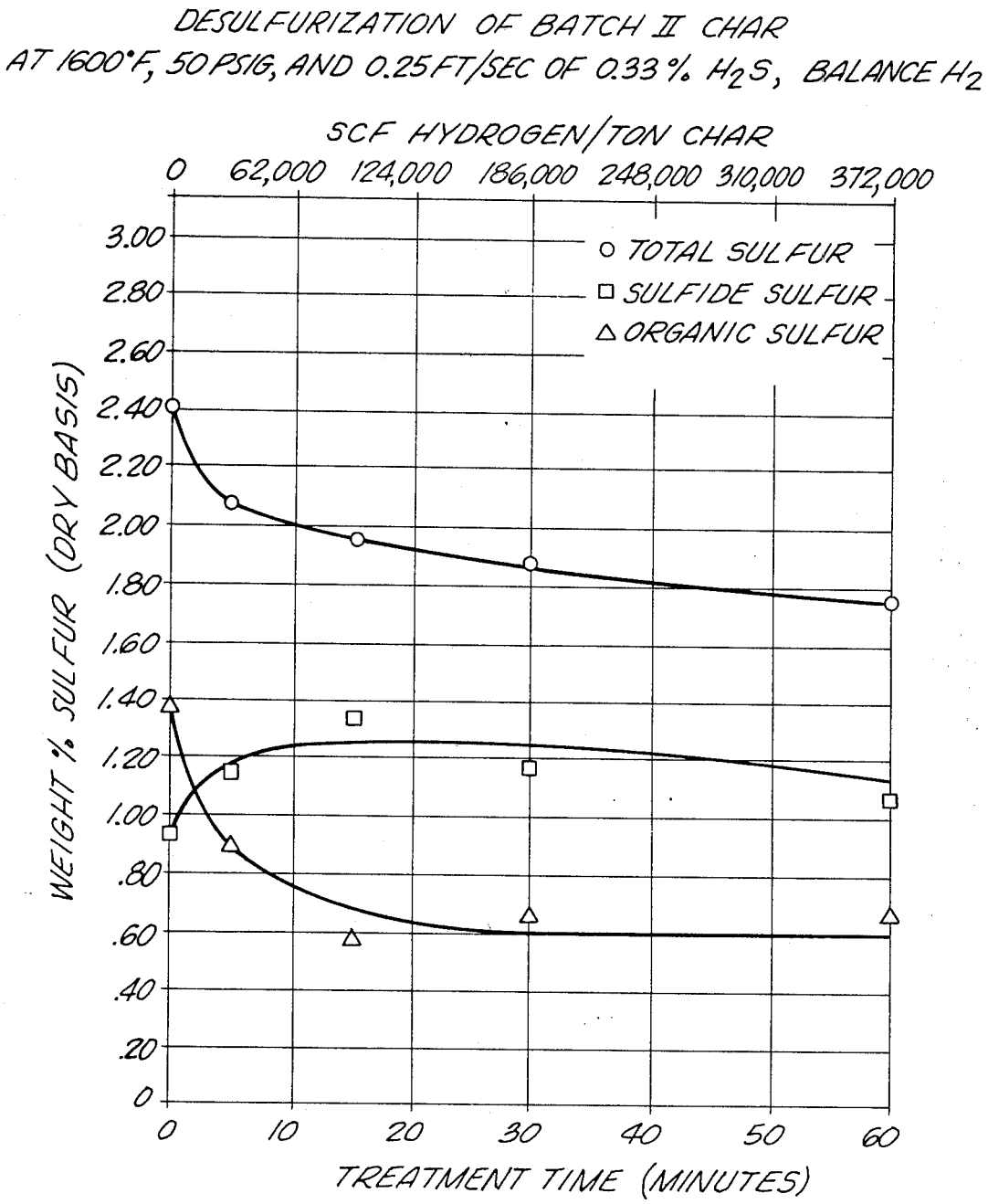
FIG. 5 is a graph of desulfurization of Batch II char with hydrogen containing 0.33 vol.% $H_2S$.
Figure 6:
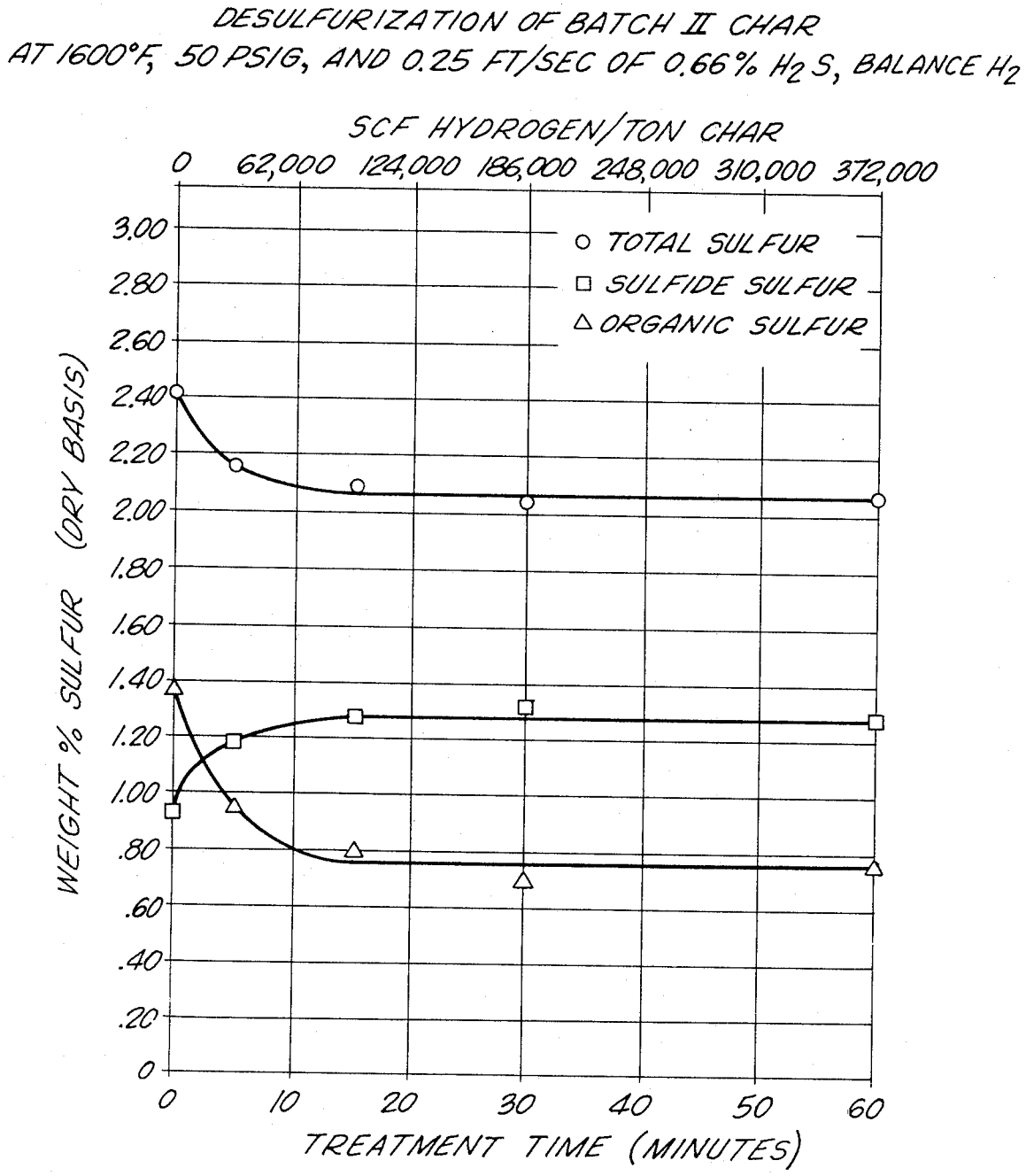
FIG. 6 is a graph of desulfurization of Batch II char with hydrogen containing 0.66 vol.% $H_2S$.

FIGS. 4, 5, and 6 represent desulfurization of Batch II char at a temperature of 1600° F., a pressure of 50 psig, with a superficial gas velocity of 0.25 feet per second of gas. FIG. 4 employs a gas which is pure hydrogen; FIG. 5 a gas containing 0.33 percent by volume hydrogen sulfide and the balance hydrogen; and FIG. 6 a gas containing 0.66 percent by volume hydrogen sulfide and the balance hydrogen.

FIG. 4 demonstrates that, for pure hydrogen treatment, the total sulfur content, sulfide sulfur content, and organic sulfur content of the char reach a somewhat constant value regardless of the period of time of hydrogen treatment, for periods from about 30 to about 150 minutes. However, when the hydrogen gas contains a small fraction of a percent of hydrogen sulfide, the sulfide and hence inorganic sulfur content of the char increases above its initial value as shown by FIGS. 5 and 6. In FIGS. 4, 5 and 6, a treating gas flow rate of 6,200 scf per minute per ton of char was used.

Figure 7:
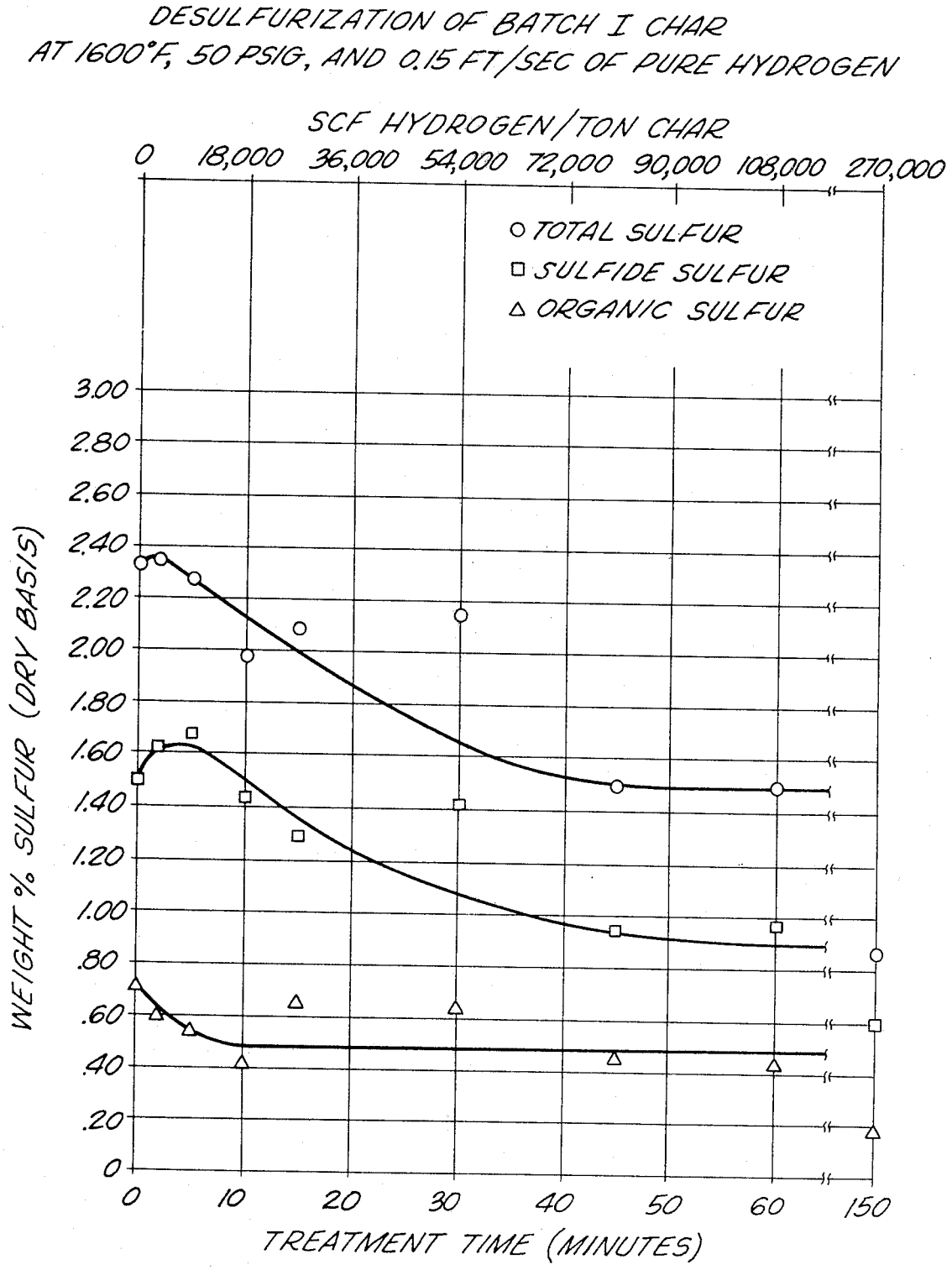
FIG. 7 is a graph of desulfurization of Batch I char with pure hydrogen.
Figure 8:
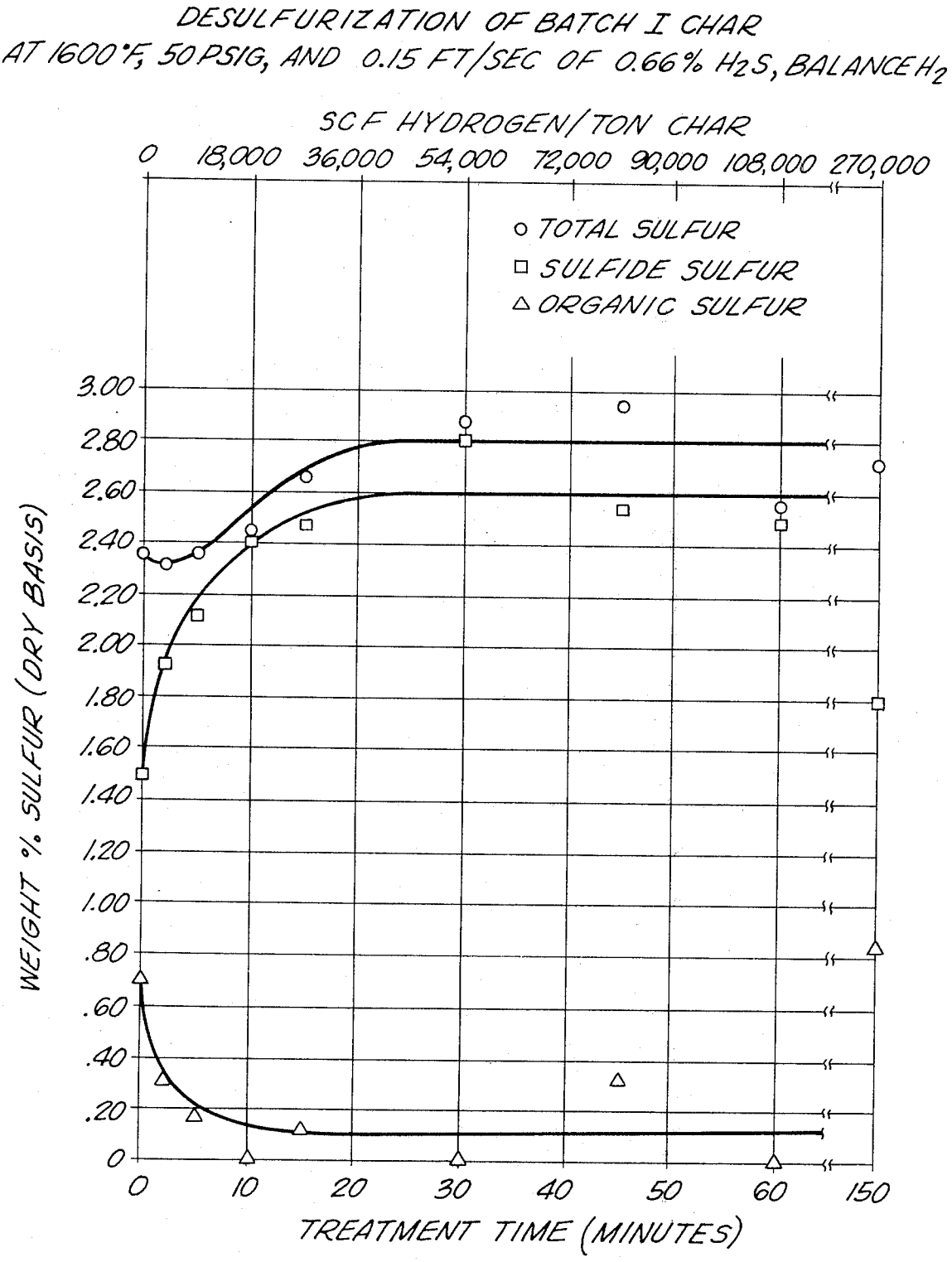
FIG. 8 is a graph of desulfurization of Batch I char with hydrogen containing 0.66 vol.% $H_2S$.
Figure 9:
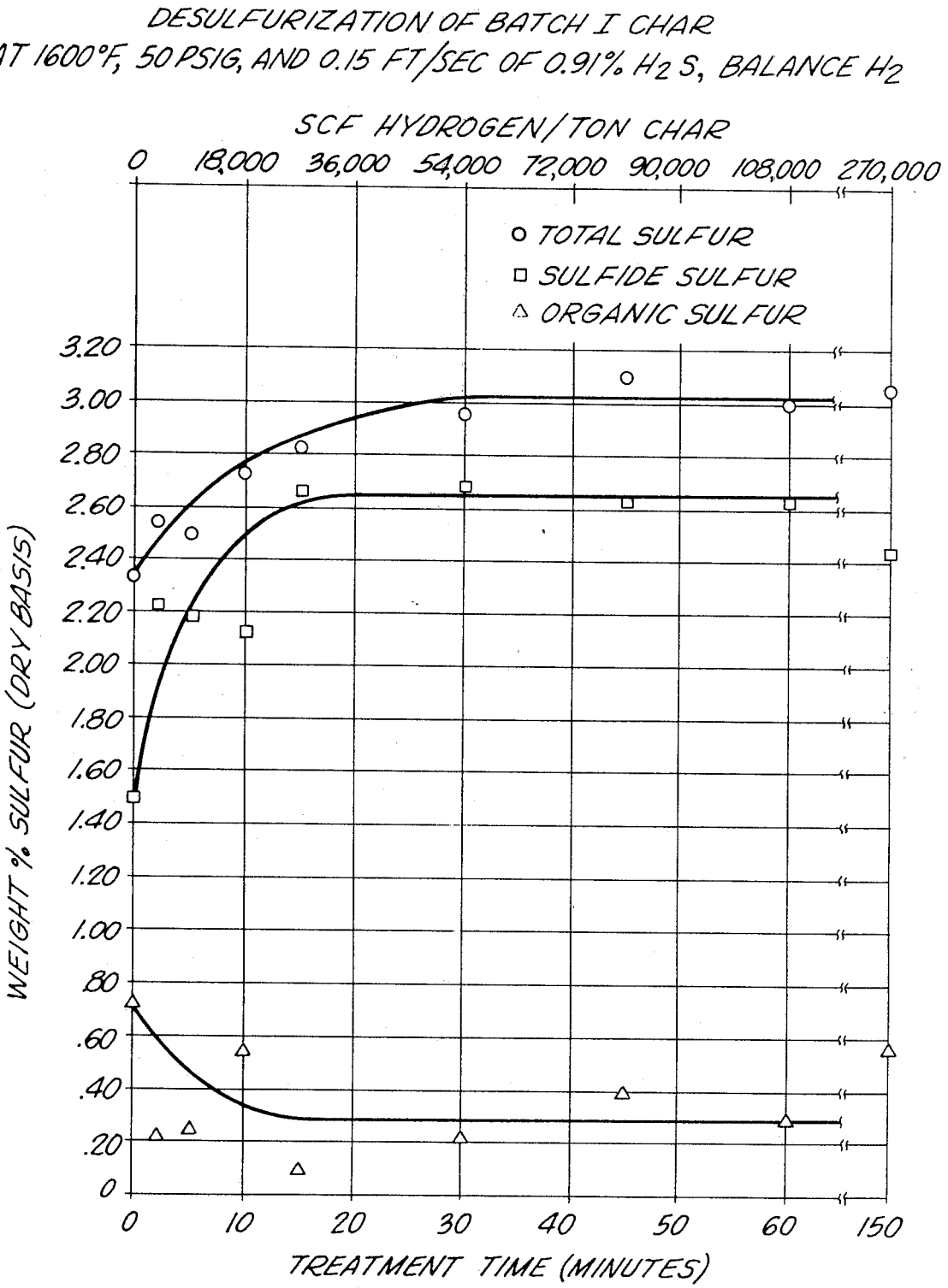
FIG. 9 is a graph of desulfurization of Batch I char with hydrogen containing 0.91 vol.% $H_2S$.

FIGS. 7, 8 and 9 represent desulfurization of Batch I char at a temperature of 1600° F., a pressure of 50 psig, with a superficial gas velocity of 0.15 feet per second of gas. FIG. 7 employs a gas which is pure hydrogen; FIG. 8 a gas containing 0.66 percent by volume hydrogen sulfide and the balance hydrogen; and FIG. 9 a gas containing 0.91 percent by volume hydrogen sulfide and the balance hydrogen.

FIG. 7, as did FIG. 4, demonstrates that, for pure hydrogen treatment, the total sulfur content, sulfide sulfur content, and organic sulfur content of the char reach a somewhat constant value regardless of the period of time of hydrogen treatment, for periods from about 40 to about 150 minutes. However, when the hydrogen gas contains a small fraction of a percent of hydrogen sulfide, the sulfide, and hence inorganic sulfur, content of the char increases above its initial value and remains at a somewhat constant level after about 20 to about 150 minutes of treatment with the gas, as shown in FIGS. 8 and 9.

The difference between FIGS. 8 and 9 and FIGS. 5 and 6, respectively, is that Batch I char employed in FIGS. 8 and 9 is capable of retaining its retaining sulfur to a much greater extent than the Batch II char represented by FIGS. 5 and 6. In FIGS. 7, 8 and 9 a flow rate of treating gas of 1,800 scf per minute per ton of char was used.

Table 1 is a comparison of Batch I and Batch II char. The first section entitled "Char Preparation" describes the conditions under which the char was produced. Batch I char was produced in a process development unit, while Batch II char was produced in a 2.5-inch diameter bench-scale reactor. Batch I char was subsequently oxidized in the bench-scale reactor. Both chars were heat-treated in fluidized bed at an elevated temperature for one hour.

This char was then analyzed and the composition is given in Section II. Section II shows that the sulfide equivalent of iron and calcium which can be removed by acid leaching is much higher, 2.7 percent by weight in Batch I char, than in Batch II char, 1.52 percent by weight. It will be appreciated that some of the iron and calcium may be present as acid insoluble compounds.

Therefore, it is not unexpected that the sulfide equivalent sulfur removed by acid leaching given in Section II of Table 1 is less than the sum of the iron and and calcium sulfide equivalents in the chars.

Section III of the Table gives the conditions and parameters during treatment of the char with the hydrogen-containing gas as shown in FIGS. 4 through 9. The treatment with the hydrogen-containing gas converts some of the organic sulfur in the char to inorganic or sulfide sulfur. The maximum amount of sulfide sulfur which was obtained by treatment with a gas containing both hydrogen and hydrogen sulfide is shown to be 2.64 percent by weight for Batch I char and 1.33 percent by weight for Batch II char. Thus, the maximum amount of sulfide sulfur obtained in the char by treatment with a gas containing hydrogen and hydrogen sulfide was found to be very close to the equivalent sulfide sulfur which could be removed from the chars by acid leaching.

EXAMPLE 1

Nine experiments were performed to show the reduction of sulfur in Batch II char using my process. The experiments involve treating char with essentially pure hydrogen in a fluidized bed to convert at least a portion of the organic sulfur to inorganic sulfur and/or sulfide sulfur; then removing at least a portion of the inorganic sulfur and/or sulfide sulfur by treating the char with steam in a fluidized bed.

Results of the nine experiments are summarized in Table 2. The process steps symbolized by the letters A, B, C and D in Table 2 are defined in Table 3. The letter A represents to a conversion step for converting organic sulfur to inorganic sulfur by treatment with hydrogen. The treatment was conducted at a temperature of 1600° F., a pressure of 50 psig, a treatment time of 30 minutes, at a superficial gas velocity through the fluidized bed of 0.10 ft/sec. These conditions correspond to hydrogen usage of 76,800 scf per ton of char.

The letter C also represents to a conversion step but the treatment time, superficial gas velocity, and hydrogen usage are lower as shown in Table 3.

The letter B represents a desulfurization step for removing sulfur from the char by treatment with steam. The treatment was conducted at a temperature of 1200° F., a pressure of 50 psig, a treatment time of 30 minutes, and at a superficial gas velocity of 0.10 ft/sec.

The letter D also represents a desulfurization step but the treatment temperature was 1100° F.

The improved result of my cyclic process is demonstrated by comparison of the results of Experiments 4 and 5 and by comparison of the results of Experiments 7 and 9.

The improved result obtained by initially desulfurizing the char in a desulfurization zone with steam prior to treatment in a conversion zone with a gas containing hydrogen is demonstrated by comparison of the results of Experiments 1 and 2 and by comparison of the results of Experiments 8 and 9.

Most important, however, the improved results obtained by my process demonstrate that a very large reduction in the amount of hydrogen required to desulfurize carbonaceous material can be achieved as shown by comparison of, for example, Experiments 4 and 9 where the amount of hydrogen was reduced from 230,000 scf per ton to 25,600 scf per ton of char. The reduction in the amount of hydrogen required to desulfurize carbonaceous material by my process represents a large savings in hydrogen cost. This is demonstrated by the amount of hydrogen required being less than 13,000 scf per ton of char per percent of sulfur reduction as shown in the column for SCF $H_2$ per ton char per % S removed of Table 2.

While I do not wish to be bound by theory, the improved results by my process are further demonstrated when compared to the theoretical hydrogen requirements calculated for hydrogen desulfurization of iron sulfide as shown in Table 4. From Table 4 it can be seen that theoretically 90,000 scf of hydrogen per ton of char is required to achieve a 1% reduction in sulfur content.

EXAMPLE 2

A high ash fraction of a solvent refined coal (SCR) has been desulfurized by my process. This high ash fraction was then coked in the presence of either nitrogen, or steam, or hydrogen. An analysis of the coked high ash fraction is given in Table 5.

The coked high ash fraction was desulfurized according to my process under the condition shown in Table 5 which also shows the experimental results achieved.

The results given in Table 6 show that the coked high ash fraction from solvent refined coal when screened through 60 mesh may be reduced from 1.91% sulfur to 1.41% sulfur, experiment No. 11. If the coked high ash fraction is screened through 200 mesh, the sulfur level is reduced to 1.13%, experiment No. 15. These results were obtained in a three-step process, that is, desulfurize-convert-desulfurize.

If a minus 200 mesh coked high ash fraction is used and a five-step process, the sulfur content of the material is reduced to 0.58%, experiment No. 16.

EXAMPLE 3

A low sulfide sulfur char was prepared by treating Batch II char with steam in a small bench scale fluidized bed reactor; the composition of the char produced is given in Table 7 as "starting char". This char was then treated in a fluidized bed with nitrogen—experiment No. 17, hydrogen—experiment Nos. 18 to 20, and with hydrogen containing less than 1% hydrogen sulfide—experiment Nos. 21 to 26. The results of these various gaseous treatments show that organic sulfur is converted to sulfide sulfur and that the total sulfur is increased significantly with gases containing hydrogen sulfide as shown by experiment Nos. 21 to 26. These results show the ability of the desulfurized char to react with the hydrogen sulfide in the gaseous stream.

EXAMPLE 4

Coal char produced in a 2.5 inch diameter bench scale transport reactor from bituminous coal was treated with a gas containing 80 percent by volume hydrogen and 20 percent nitrogen at various temperatures from 1100° F. to 1600° F. Two treatment times were investigated; namely, ten seconds and one minute. The treatment was conducted in a 35 mm bench scale fluidized bed reactor.

The chemical analysis of the treated chars, shown in Table 8, experiment Nos. 27 to 38, shows that more organic sulfur is converted for treatment times of one minute than for treatment times of ten seconds, and that treatment temperatures of 1300° and 1400° F. are as effective as treatment temperature of 1600° F.

While the embodiment of the invention shown herein for purposes of disclosure is at present considered to be preferred, it is to be understood that this invention is intended to cover all changes and modifications in the disclosed embodiments which fall within the spirit and scope of the invention.

TABLE 1

COMPARISON OF BATCH I AND BATCH II CHAR

| Batch. No. | I | II |
|---|---|---|
| I. Char Preparation | | |
| Run No. | 110-75 | 129 |
| Flash Pyrolysis Reactor | 1200° F., 2.5 sec. PDU* | 1075° F., 0.69 sec. 2.5" Bench-Scale Reactor |
| Pyrolysis Carrier Gas | Product of Inert Gas Generator | 3 vol. % $O_2$, balance $N_2$ |
| Subsequent Oxidation in Bench-Scale Reactor | 1600° F., 0.1 sec., 5.6 vol. % $O_2$ | None |
| Heat Treated in Fluidized Bed Reactor | 1600° F., 1 hr, $N_2$ | 1400° F., 1 hr, $N_2$ |
| II. Analysis of Char Composition (Dry Basis) Before Treatment with Hydrogen Containing Gas | | |
| Ash | 24.77 | 18.93 |
| Volatile Matter | 5.17 | 6.25 |
| Carbon | 72.98 | 72.26 |
| Hydrogen | 0.83 | 1.94 |
| Nitrogen | — | 1.94 |
| Oxygen (by diff.) | — | 1.92 |
| N + O (by diff.) | 0 | 3.86 |
| Total Sulfur | 2.33 | 2.41 |
| Sulfide Sulfur | 1.49 | 0.88 |
| Pyrite Sulfur | 0.13 | 0.08 |
| Sulfate Sulfur | 0 | 0.01 |
| Organic Sulfur (by diff.) | 0.71 | 1.45 |
| Surface Area ($m^2/g$) | 85 | 104 |
| True Density (g/cc) | 2.01 | 1.88 |
| Apparent Density (g/cc) | 1.72 | 1.06 |
| % Fe in Ash | 16.2 | 11.8 |
| % Ca in Ash | 3.96 | 2.70 |
| % Fe in Char | 4.01 | 2.25 |
| % Ca in Char | 0.98 | 0.52 |
| % Sulfide Equivalent of Fe in Char | 2.27 | 1.29 |
| % Sulfide Equivalent of Ca in Char | 0.78 | 0.42 |
| % Sulfide Equivalent of Fe & Ca Removed by Acid Leaching Char | 2.70 | 1.52 |
| III. Conditions and Parameters During Treatment with Hydrogen Containing Gas | | |
| Reactor I.D. (mm) | 19 | 35 |
| Temperature (°F.) | 1600 | 1600 |
| Pressure (psig) | 50 | 50 |
| Sample Size (gr) | 15 | 25 |
| Gas Flow Rate (scf/min/ton of char) | 1800 | 6200 |
| Superficial Velocity (ft/sec) | 0.15 | 0.25 |
| % Maximum sulfide Observed | | |

TABLE 1-continued

COMPARISON OF BATCH I AND BATCH II CHAR

| Batch. No. | I | II |
|---|---|---|
| after $H_2S/H_2$ Treatment | 2.64 | 1.33 |

*Process Development Unit — A 4 inch diameter down flow entrained or transport reactor.

All percentages are by weight unless otherwise specified.

TABLE 2

Batch II Char Desulfurization Results

| Experiment No. | Process Steps | Weight % Total Sulfur | Weight % Sulfide Sulfur | Weight % Organic Sulfur | SCF $H_2$/ton char | SCF $H_2$/ton char/% S Removed | % Sample Recovery |
|---|---|---|---|---|---|---|---|
| — | Starting Char | 2.42 | 0.59 | 1.73 | — | — | — |
| 1 | A,B | 0.64 | 0.13 | 0.43 | 76,800 | 43,100 | 85.24 |
| 2 | B,A,B | 0.49 | 0.03 | 0.37 | 76,800 | 39,800 | 82.96 |
| 3 | A,B,A,B | 0.34 | 0.04 | 0.29 | 153,600 | 73,800 | 77.84 |
| 4 | A,B,A,B,A,B | 0.23 | 0.05 | 0.13 | 230,400 | 105,000 | 77.36 |
| 5 | A,A,A,B,B,B | 0.46 | 0.18 | 0.18 | 230,400 | 118,000 | 81.12 |
| — | Starting Char | 2.48 | 0.80 | 1.59 | — | — | — |
| 6 | C,D | 0.94 | 0.34 | 0.52 | 12,800 | 8,300 | 92.28 |
| 7 | C,C,D,D,D | 0.50 | 0.10 | 0.27 | 25,600 | 12,900 | 91.64 |
| 8 | C,D,C,D | 0.43 | 0.14 | 0.22 | 25,600 | 12,500 | 85.48 |
| 9 | D,C,D,C,D | 0.27 | 0.11 | 0.09 | 25,600 | 11,600 | 81.04 |

TABLE 3

| | |
|---|---|
| Convert Steps: | |
| A. | 1600° F., $H_2$, 50 psig, 30 min, 0.10 ft/sec |
| C. | 1600° F., $H_2$, 50 psig, 10 min, 0.05 ft/sec |
| Desulfurization Steps: | |
| B. | 1200° F., steam, 50 psig, 30 min, 0.10 ft/sec |
| D. | 1100° F., steam, 50 psig, 30 min, 0.10 ft/sec |

TABLE 4

The $FeS/H_2$ Equilibrium Reaction $$FeS + H_2 = Fe + H_2S$$

$$\Delta F = 15{,}580 - 3.79T(°K.) \quad 77 \text{ to } 282° \text{ F.}$$
$$= 14{,}330 - 0.75T \quad 282 \text{ to } 1663° \text{ F.}$$
$$= 14{,}490 - 0.93T \quad 1663 \text{ to } 1810° \text{ F.}$$

$$Keq. = \frac{(H_2S)}{(H_2)}$$

Theoretical Hydrogen Requirement

| T(°F.) | SCF $H_2$/Ton Char/1% Weight Sulfur Change | Keq. |
|---|---|---|
| 1300 | 264,000 | $9.12 \times 10^{-4}$ |
| 1400 | 177,000 | $1.36 \times 10^{-3}$ |
| 1500 | 124,000 | $1.94 \times 10^{-3}$ |
| 1600 | 90,000 | $2.68 \times 10^{-3}$ |
| 1700 | 66,000 | $3.66 \times 10^{-3}$ |
| 1800 | 50,000 | $4.79 \times 10^{-3}$ |

TABLE 5

Composition of Coked High Ash Fraction From High Ash Solvent Refined Coal

| Description | Weight % Moist | Ash | Total Sulfur | Sulfide Sulfur | Approx. Organic S | Weight % Recovered |
|---|---|---|---|---|---|---|
| Starting Material | 0 | 11.53 | 2.20 | 0.64 | 1.56 | — |
| $N_2$ Coked HAF at 950° F., 2 hrs | 0.40 | 10.92 | 1.91 | 0.41 | 1.50 | 70 |
| Steam Coked | | | | | | |

TABLE 5-continued

| Description | Composition of Coked High Ash Fraction From High Ash Solvent Refined Coal Weight % Moist | Ash | Total Sulfur | Sulfide Sulfur | Approx. Organic S | Weight % Recovered |
|---|---|---|---|---|---|---|
| HAF at 1100° F., 1 hr | 0.38 | 17.21 | 2.41 | 0.35 | 2.06 | 57 |
| $H_2$ Coked HAF at 950° F., 1 hr | 0.16 | 10.93 | 1.90 | 0.28 | 1.62 | 64 |

HAF: High Ash Fraction

TABLE 6

Desulfurization of Coked High Ash Fraction

| Experiment No. | Processing Steps Description* | Weight % Moist | Ash $N_2$ Coked | Total Sulfur | Sulfide Sulfur | Approx. Organic S | Weight % Recovered |
|---|---|---|---|---|---|---|---|
| — | Starting Material | 0.40 | 10.92 | 1.91 | 0.41 | 1.50 | 70 |
| 10 | D,C(10 min),D | 0.20 | 15.57 | 1.79 | 0.04 | 1.75 | 79 |
| 11 | D,C(30 min),D | 0.15 | 13.41 | 1.41 | 0.06 | 1.35 | 86 |
| 12 | C(60 min) | 0 | 13.59 | 1.71 | 0.27 | 1.44 | 87 |
| 13 | C(60 min),D(60 min) | 1.73 | 13.36 | 1.52 | 0.05 | 1.47 | 87 |
| 14 | D,C(30 min,1800° F.),D | 0.02 | 13.97 | 1.45 | 0.10 | 1.35 | 83 |
| 15 | D,C(30 min), D (−200 mesh) | 0.06 | 17.35 | 1.13 | 0.18 | 0.95 | 79 |
| | | | | $H_2$ Coked SRC | | | |
| — | Starting Material | 0.16 | 10.93 | 1.90 | 0.28 | 1.62 | 64 |
| — | Starting Material (−200 mesh) | 0.16 | 13.43 | 1.97 | 0.75 | 1.22 | — |
| 16 | D,C,D,C,D (−200 mesh) | 0.11 | 16.20 | 0.58 | 0.08 | 0.50 | 77 |

*D — Desulfurization Step-Steam, 1100° F., 50 psig
C — Conversion Step-Hydrogen, 1600° F. (unless otherwise indicated), 50 psig
Unless otherwise indicated, particle size is −60 mesh

TABLE 7

Organic Sulfur Conversion in a Low Sulfide Sulfur Char

| Experiment No. | Treatment Gas | Superficial Velocity (ft./sec.) | Approximate scf $H_2$/ton char/% S Removed | Weight % Dry Basis Ash | Volatile Matter | Total Sulfur | Sulfide Sulfur | Pyrite Sulfur | Sulfate Sulfur | Organic Sulfur | % in Ash Fe | Ca |
|---|---|---|---|---|---|---|---|---|---|---|---|---|
| — | Starting Char | — | — | 19.83 | 6.11 | 1.68 | 0.17 | 0.10 | 0 | 1.41 | 11.6 | 2.01 |
| 17 | $N_2$, 0 psig | 0.10 | — | 20.47 | 2.73 | 1.76 | 0.42 | 0.06 | 0.02 | 1.26 | 12.1 | 2.92 |
| 18 | $H_2$ | 0.05 | 104,000 | 21.48 | 2.10 | 1.32 | 0.89 | 0.03 | 0 | 0.40 | 12.2 | 2.83 |
| 19 | " | 0.10 | 72,800 | 21.37 | 2.02 | 0.65 | 0.30 | 0.03 | 0 | 0.32 | 12.3 | 2.86 |
| 20 | " | 0.15 | 97,000 | 21.66 | 1.89 | 0.52 | 0.24 | 0.03 | 0 | 0.25 | 12.1 | 2.84 |
| 21 | 0.3% vol. $H_2S$(1) | 0.05 | — | 21.66 | 2.15 | 2.01 | 1.21 | 0.03 | 0 | 0.77 | 12.7 | 2.89 |
| 22 | " | 0.10 | — | 21.20 | 1.64 | 1.91 | 1.27 | 0.03 | 0 | 0.61 | 12.0 | 2.82 |
| 23 | " | 0.15 | — | 21.42 | 2.07 | 1.92 | 1.21 | 0.02 | 0 | 0.69 | 12.4 | 2.87 |
| 24 | 0.6% vol. $H_2S$(1) | 0.05 | — | 21.07 | 1.98 | 2.11 | 1.41 | 0.02 | 0 | 0.68 | 12.0 | 2.70 |
| 25 | " | 0.10 | — | 21.11 | 2.03 | 2.13 | 1.34 | 0.02 | 0 | 0.77 | 12.2 | 2.88 |
| 26 | " | 0.15 | — | 21.17 | 2.14 | 2.09 | 1.36 | 0.02 | 0 | 0.71 | 12.2 | 2.88 |

Experiments conducted at 1600° F., 50 psig (unless otherwise indicated), and 30 minutes in a 35 mm fluidized bed reactor
(1)balance $H_2$

TABLE 8

The Effect of Temperature on Organic Sulfur Conversion

| Experiment No. | Treatment (1) | Weight % on dry basis Total S | Sulfide S | Organic S | Ash | SCF $H_2$ ton char |
|---|---|---|---|---|---|---|
| — | Starting Char (2) | 2.40 | 1.02 | 1.29 | 19.60 | — |
| 27 | 10 sec, 1100° F. | 2.43 | 0.95 | 1.43 | 19.87 | 167 |
| 28 | 1200° F. | 2.43 | 1.08 | 1.30 | 19.90 | " |
| 29 | 1300° F. | 2.40 | 1.04 | 1.32 | 20.05 | " |
| 30 | 1400° F. | 2.44 | 1.17 | 1.23 | 20.21 | " |
| 31 | 1500° F. | 2.43 | 1.25 | 1.14 | 20.55 | " |
| 32 | 1600° F. | 2.54 | 1.03 | 1.44 | 20.27 | " |
| 33 | 1 min, 1100° F. | 2.35 | 1.21 | 1.08 | 19.79 | 1000 |
| 34 | 1200° F. | 2.33 | 0.90 | 1.39 | 18.98 | " |
| 35 | 1300° F. | 2.41 | 1.59 | 0.76 | 20.73 | " |
| 36 | 1400° F. | 2.31 | 1.54 | 0.71 | 20.32 | " |
| 37 | 1500° F. | 2.41 | 1.47 | 0.90 | 20.45 | " |
| 38 | 1600° F. | 2.39 | 1.33 | 1.02 | 20.53 | " |

(1) 50 PSIG, 80% vol. $H_2$, 20% vol. $N_2$
(2) Run 129-5 char

What I claim is:

1. A process for desulfurizing a solid carbonaceous material comprising treating a sulfur-bearing solid carbonaceous material having organic sulfur and having an initial total sulfur percent with a gas comprising hydrogen under conditions of temperature and time sufficient to transform said organic sulfur to inorganic sulfur and to produce a converted solid carbonaceous material, and controlling said treating so that the total sulfur percent of said converted solid carbonaceous material is at least about 80 percent of said initial total sulfur percent by controlling the amount of said hydrogen used; and treating said converted solid carbonaceous material to remove at least a portion of the thusly formed inorganic sulfur and to produce a solid carbonaceous material product.

2. The process of claim 1 wherein said treating with a gas comprising hydrogen is such that said converted solid carbonaceous material has a total sulfur percent of at least about the same percent as said initial total sulfur percent.

3. The process of claim 1 wherein said treating of said converted solid carbonaceous material is by treating with an aqueous acid solution.

4. The process of claim 1 wherein said treating of said converted solid carbonaceous material is by partially oxidizing said converted solid carbonaceous material.

5. The process of claim 1 wherein said treating of said converted solid carbonaceous material is by magnetically separating sulfur values from said converted solid carbonaceous material.

6. The process of claim 1 wherein said treating of said converted solid carbonaceous material is by treating with a gas comprising steam.

7. A process for desulfurizing a solid carbonaceous material comprising treating a sulfur-bearing solid carbonaceous material having both organic sulfur and metal compounds with a gas comprising hydrogen under conditions of temperature and time sufficient to transform said organic sulfur to sulfide sulfur and to produce a converted solid carbonaceous material, and controlling said treating so that the total sulfur content of said converted solid carbonaceous material is essentially the same percent as that of said sulfur-bearing solid carbonaceous material by controlling the amount of said hydrogen used; and treating said converted solid carbonaceous material to remove the thusly formed sulfide sulfur and to produce a solid carbonaceous material product.

8. The process of claim 1 or 7, wherein said process for treating of said solid carbonaceous material is repeated.

9. The process of claim 7 wherein said treating of said converted solid carbonaceous material is by treating with a gas comprising steam.

10. The process of claim 6 or 9 wherein said treating with a gas comprising steam occurs in a fluidized bed, and said treating with a gas comprising hydrogen occurs in a fluidized bed.

11. The process of claim 7 wherein said treating of said converted solid carbonaceous material is by treating with an aqueous acid solution.

12. The process of claim 7 wherein said treating of said converted solid carbonaceous material is by partially oxidizing of said converted solid carbonaceous material.

13. The process of claim 7 wherein said treating of said converted solid carbonaceous material is by magnetically separating sulfur values from said converted solid carbonaceous material.

14. A process for desulfurizing a sulfur-bearing solid carbonaceous material comprising:

a. treating a first sulfur-bearing solid carbonaceous material having both organic sulfur and metal compounds in a first desulfurization zone maintained at an elevated temperature with a gas comprising steam to produce a second solid carbonaceous material of lower sulfur content than said first solid carbonaceous material;

b. treating said second solid carbonaceous material with a gas comprising hydrogen in a first conversion zone maintained at an elevated temperature to transform said organic sulfur to sulfide sulfur and to produce a third solid carbonaceous material containing said sulfide sulfur thusly formed, and maintaining the total sulfur content of said third solid carbonaceous material at essentially the same percent as that of said second solid carbonaceous material;

c. treating said third solid carbonaceous material in a second desulfurization zone maintained at an elevated temperature with a gas comprising steam to remove at least a portion of the sulfide sulfur thereof and to produce a fourth solid carbonaceous material of lower sulfur content than said third solid carbonaceous material;

d. treating said fourth solid carbonaceous material in a second conversion zone maintained at an elevated temperature with a gas comprising hydrogen to transform organic sulfur to sulfide sulfur and to produce a fifth solid carbonaceous material containing said sulfide sulfur thusly formed, and maintaining the total sulfur content of said fifth solid carbonaceous material at essentially the same percent as that of said fourth solid carbonaceous material; and e. treating said fifth solid carbonaceous material from said second conversion zone in a third desulfurization zone to remove at least a portion of the sulfide sulfur thereof and to produce a solid carbonaceous material product or lower sulfur content.

15. A process for desulfurizing a solid carbonaceous material comprising:

a. treating a fresh solid carbonaceous material having both organic sulfur and metal compounds in a first desulfurization zone maintained at an elevated temperature with a gas comprising steam to produce a solid carbonaceous material of lower sulfur content;

b. treating said solid carbonaceous material from said first desulfurization zone with a gas comprising hydrogen in a first conversion zone maintained at an elevated temperature to transform said organic sulfur to sulfide sulfur within said solid carbonaceous material wherein the total amount of hydrogen in said gas is less than about 10,000 scf of hydrogen per ton of said carbonaceous material treated with said gas in said first conversion zone;

c. treating said solid carbonaceous material from said first conversion zone in a second desulfurization zone maintained at an elevated temperature with a gas comprising steam to remove at least a portion of the sulfide sulfur thereof and to produce a solid carbonaceous material of lower sulfur content;

d. treating said solid carbonaceous material from said second desulfurization zone in a second conversion zone maintained at an elevated temperature with a gas comprising hydrogen to transform organic sulfur to sulfide sulfur within said solid carbonaceous material wherein the total amount of hydrogen in said gas is less than about 10,000 scf of hydrogen per ton of solid carbonaceous material treated with said gas in said second conversion zone; and e. treating said solid carbonaceous material from said second conversion zone in a third desulfurization zone to remove at least a portion of the sulfide sulfur thereof and to produce a solid carbonaceous material product of lower sulfur content.

16. The process of claim 1, or 7, or 14, or 15, wherein said gas comprising hydrogen also comprises hydrogen sulfide.

17. The process of claim 14 wherein said gas comprising hydrogen also comprises up to about 2 mole percent hydrogen sulfide.

18. The process of claim 1, 7, or 14, wherein the amount of hydrogen in said gas comprising hydrogen used in treating said sulfur-bearing solid carbonaceous material is no greater than about 90,000 scf of hydrogen per ton of sulfur-bearing solid carbonaceous material introduced into said process as fresh solid feed per percent sulfur removed based on the difference in the sulfur percent of said sulfur-bearing solid carbonaceous material introduced into said process as fresh material and the sulfur percent of said solid carbonaceous material product.

19. The process of claim 18 wherein said amount of hydrogen is no greater than about 15,000 scf of hydrogen per ton of sulfur-bearing solid carbonaceous material introduced into said process as fresh solid feed per percent sulfur removed based on the difference in the sulfur percent of said sulfur-bearing solid carbonaceous material introduced into said process as fresh material and the sulfur percent of said solid carbonaceous material product.

20. The process of claim 18 wherein said amount of hydrogen is no greater than about 13,000 scf of hydrogen per ton of sulfur-bearing solid carbonaceous material introduced into said process as fresh solid feed per percent sulfur removed based on the difference in the sulfur percent of said sulfur-bearing solid carbonaceous material introduced into said process as fresh material and the sulfur percent of said solid carbonaceous material product.

21. The process of claim 1, or 7, or 14, or 15, wherein said solid carbonaceous material is selected from the group consisting of coal char, a product produced from coal char, solvent refined coal, or a product produced from solvent refined coal.

22. The process of claim 15 wherein the total amount of hydrogen utilized in said process, said total amount of hydrogen being equal to the sum of the hydrogen contained in said gas comprising hydrogen utilized in said first conversion zone and the hydrogen contained in said gas comprising hydrogen utilized in said second conversion zone, is no greater than about 15,000 scf of hydrogen per ton of said fresh solid carbonaceous material per percent sulfur removed, based on the difference in the sulfur percent of said fresh solid carbonaceous material and the sulfur percent of said solid carbonaceous material product.

23. The process of claim 14, or 15, wherein said elevated temperature of said first desulfurization zone is between about 800° to about 1600° F., said elevated temperature of said first conversion zone is between about 1000° to about 2000° F., said elevated temperature of said second desulfurization zone is between about 800° to about 1600° F., said elevated temperature of said second conversion zone is between about 1000° to about 2000° F., and said third desulfurization zone is maintained at a temperature between about 800° to about 1600° F. and said treating in said third desulfurization zone is with a gas comprising steam.

24. The process of claim 14, or 15, wherein said elevated temperature of said first desulfurization zone is between about 800° to about 1400° F., said elevated temperature of said first conversion zone is between about 1200° to about 1600° F., said elevated temperature of said second desulfurization zone is between about 800° to about 1400° F., said elevated temperature of said second conversion zone is between about 1200° to about 1600° F., and said third desulfurization zone is maintained at a temperature between about 800° to about 1400° F. and said treating in said third desulfurization zone is with a gas comprising steam.

25. The process of claim 14 or 15 wherein said treating with a gas comprising steam in said first and said second desulfurization zones occurs in a fluidized bed, and said treating with a gas comprising hydrogen in said first and said second conversion zones occurs in a fluidized bed.

26. A process for converting organic sulfur in a coal char to sulfide sulfur comprising treating a coal char having organic sulfur with a gas comprising hydrogen and up to about 2 mole percent hydrogen sulfide under conditions of temperature and time such that said organic sulfur is transformed to sulfide sulfur thereby producing a converted coal char, and controlling said treating so that the percent organic sulfur in said converted coal char is no greater than about 60 percent of the percent organic sulfur in said coal char before said treating, the percent sulfide sulfur in said converted coal char is much higher than the percent sulfide sulfur in said coal char before said treating, and the percent total sulfur in said converted coal char is the same or higher than the percent total sulfur in said coal char before said treating.

27. A process for converting organic sulfur in a coal char to sulfide sulfur comprising treating a coal char having organic sulfur with a gas comprising hydrogen under conditions of temperature and time such that said organic sulfur is transformed to sulfide sulfur thereby producing a converted coal char, and controlling said treating so that the percent organic sulfur in said converted coal char is no greater than about 80 percent of the percent organic sulfur in said coal char before said treating, and the percent sulfide sulfur in said converted coal char is greater than about 120 percent sulfide sulfur in the coal char before said treating, and the percent total sulfur in said converted coal char is about the same or higher than the percent toal sulfur in said coal char before said treating.

28. A process for converting organic sulfur in a sulfur-bearing solid carbonaceous material to inorganic sulfur comprising treating a sulfur-bearing solid carbonaceous material having organic sulfur with a gas comprising hydrogen under conditions of temperature and time such that said organic sulfur is transformed to inorganic sulfur within said solid carbonaceous material thereby producing a converted solid carbonaceous material, and controlling said treating so that an amount of hydrogen less than about 10,000 standard cubic feet per ton of said solid carbonaceous material is used.

29. The process of claim 28 wherein said amount of hydrogen used is no greater than about 6,000 standard cubic feet per ton of said solid carbonaceous material.

30. The process of claim 28 wherein said amount of hydrogen used is about 1,000 standard cubic feet per ton of said solid carbonaceous material.

31. The process of claim 28, 29 or 30 wherein said solid carbonaceous material is coal char.

* * * * *